US007762689B2

(12) United States Patent
Xu et al.

(10) Patent No.: US 7,762,689 B2
(45) Date of Patent: Jul. 27, 2010

(54) LED LAMP

(75) Inventors: Fang-Wei Xu, Shenzhen (CN); Guang Yu, Shenzhen (CN); Cheng-Tien Lai, Taipei Hsien (TW)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 240 days.

(21) Appl. No.: 11/933,996

(22) Filed: Nov. 1, 2007

(65) Prior Publication Data

US 2009/0059605 A1 Mar. 5, 2009

(30) Foreign Application Priority Data

Aug. 31, 2007 (CN) ..... 2007 1 0076754

(51) Int. Cl.
*F21V 29/00* (2006.01)

(52) U.S. Cl. ..... 362/294; 362/373

(58) Field of Classification Search ..... 362/294, 362/373; 361/711, 717, 719
See application file for complete search history.

(56) References Cited

U.S. PATENT DOCUMENTS 7,079,041 B2 7/2006 Fredericks et al.
2005/0128710 A1* 6/2005 Beitelmal et al. ..... 361/709
2005/0152146 A1* 7/2005 Owen et al. ..... 362/294
2006/0133090 A1* 6/2006 Noh et al. ..... 362/294
2007/0081342 A1* 4/2007 Szeto ..... 362/294
2007/0285924 A1* 12/2007 Morris et al. ..... 362/264
2008/0074881 A1* 3/2008 Liaw ..... 362/294
2008/0192508 A1* 8/2008 Busby ..... 362/647

FOREIGN PATENT DOCUMENTS

CN 1664433 A 9/2005
CN 2783120 Y 5/2006

* cited by examiner

*Primary Examiner*—Stephen F. Husar
*Assistant Examiner*—Peggy A. Neils
(74) *Attorney, Agent, or Firm*—Jeffrey T. Knapp

(57) ABSTRACT

An LED lamp includes a heat dissipation apparatus with a base, an LED module mounted on the base, and an AC-DC converter electrically connected to the LED module. The AC-DC converter is mounted on the base near the LED module. Heat generated by the LED module and heat-generating components of the AC-DC converter is transferred to the base from which the heat is dissipated by the heat dissipation apparatus. Heat pipes are embedded in the base of the heat dissipation apparatus.

12 Claims, 6 Drawing Sheets

LED LAMP

BACKGROUND OF THE INVENTION

1. Field of the Invention

The present invention relates to an LED lamp, and particularly to an LED lamp having a heat dissipation apparatus for heat dissipation.

2. Description of Related Art

Significant advances have been made in the technology of light emitting diodes (LEDs). LEDs are commercially available which generate 10-15 lumens/watt. This is comparable to the performance of incandescent bulbs. In addition, LEDs offer other advantages such as longer operating life, shock/vibration resistance and design flexibility because of their small size. As a result, LEDs are replacing traditional incandescent sources for illumination applications such as signage, and pathway lighting.

Typically, LED performance is affected by the driving current and by the ambient temperature surrounding the LED. Both of these parameters contribute to the junction temperature of the LED, which affects the performance. When applying LEDs for display backlighting or other illumination applications, there are two reasons to drive them with constant current: one is to avoid violating the absolute maximum current rating and compromising the reliability; the second is to obtain predictable and matched luminous intensity and chromaticity from each LED.

The power source for an LED is a direct current (DC) and low voltage power; therefore, the traditional power source of high voltage, alternating current (AC) power which is used to power the tungsten lamp or daylight lamp can not be directly used in powering the LED lamps. Therefore, an LED lamp generally includes an AC/DC converter that converts an AC, high voltage power to a DC, low voltage power to be supplied to the LEDs. The AC/DC converter will generate a significant amount of heat that must be dissipated to ensure reliable operation of the LED lamp. Furthermore, the LED lamp usually uses a plurality of closely packed LEDs, and most of the LEDs are driven at the same time, which results in a quick rise in temperature of the LED lamp.

However, since generally the LED lamp does not have heat dissipation devices with good heat dissipating efficiencies, operation of the general LED lamp has a problem of instability because of the rapid buildup of heat. Consequently, the light from the LED lamp often flickers, which degrades the quality of the illumination. Furthermore, if the LED lamp is used in a hot state for a long time, the life time thereof is consequently shortened.

What is needed, therefore, is an LED lamp which has a greater heat-dissipation capability.

SUMMARY OF THE INVENTION

An LED lamp comprises a heat dissipation apparatus with a base, an LED module mounted on the base, and an AC-DC converter electrically connected to the LED module. The AC-DC converter is mounted on the base near the LED module. A plurality of heat pipes is embedded in the base of the heat dissipation apparatus. Heat generated by the LED module and the AC-DC converter is transferred to the base and the heat pipes from which the heat is transferred to fins of the heat dissipation apparatus to be dissipated to ambient air.

BRIEF DESCRIPTION OF THE DRAWINGS

Many aspects of the present LED lamp can be better understood with reference to the following drawings. The components in the drawings are not necessarily drawn to scale, the emphasis instead being placed upon clearly illustrating the principles of the present LED lamp. Moreover, in the drawings, like reference numerals designate corresponding parts throughout the several views.

DETAILED DESCRIPTION OF THE INVENTION

Figure 1:
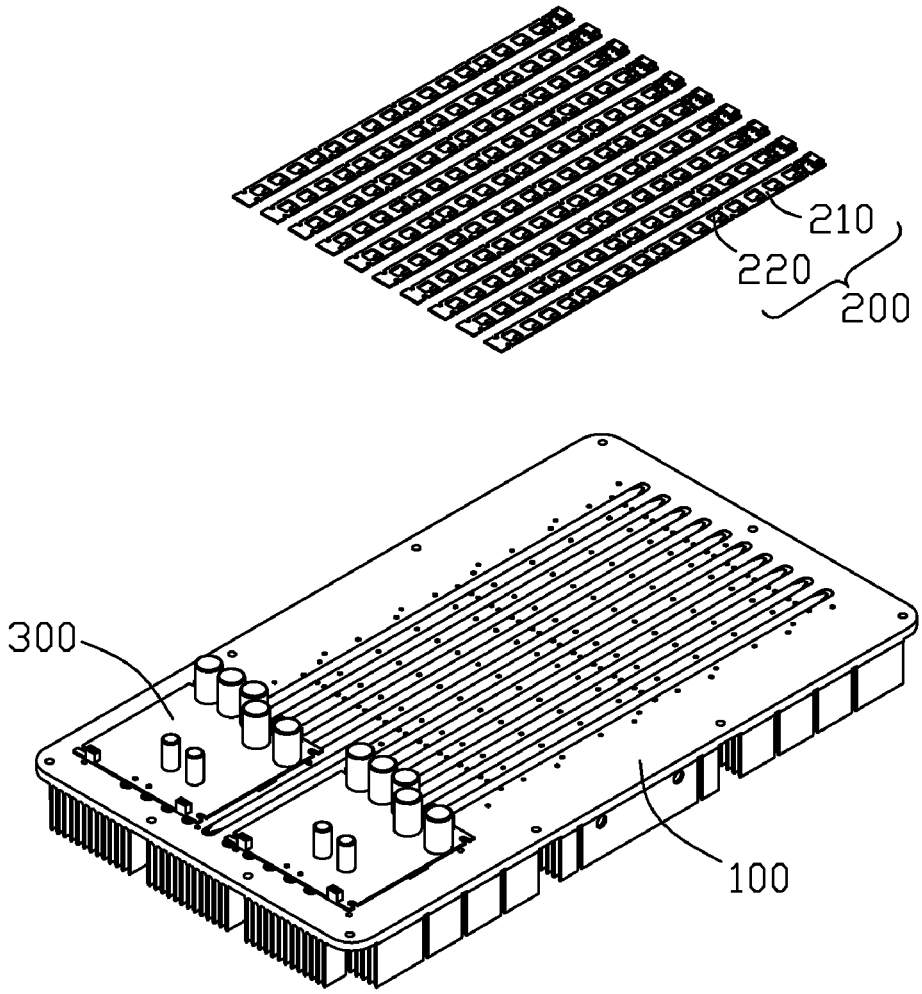
FIG. 1 is a partly assembled view of an LED lamp in accordance with a preferred embodiment of the present invention.

Referring to FIG. 1, an LED lamp of a preferred embodiment of the invention comprises a heat dissipation apparatus 100, an LED module 200 and two AC/DC converters 300. The LED module 200 and the converters 300 are mounted on a top surface of the heat dissipation apparatus 100, and cooled by the heat dissipation apparatus 100.

Figure 2:
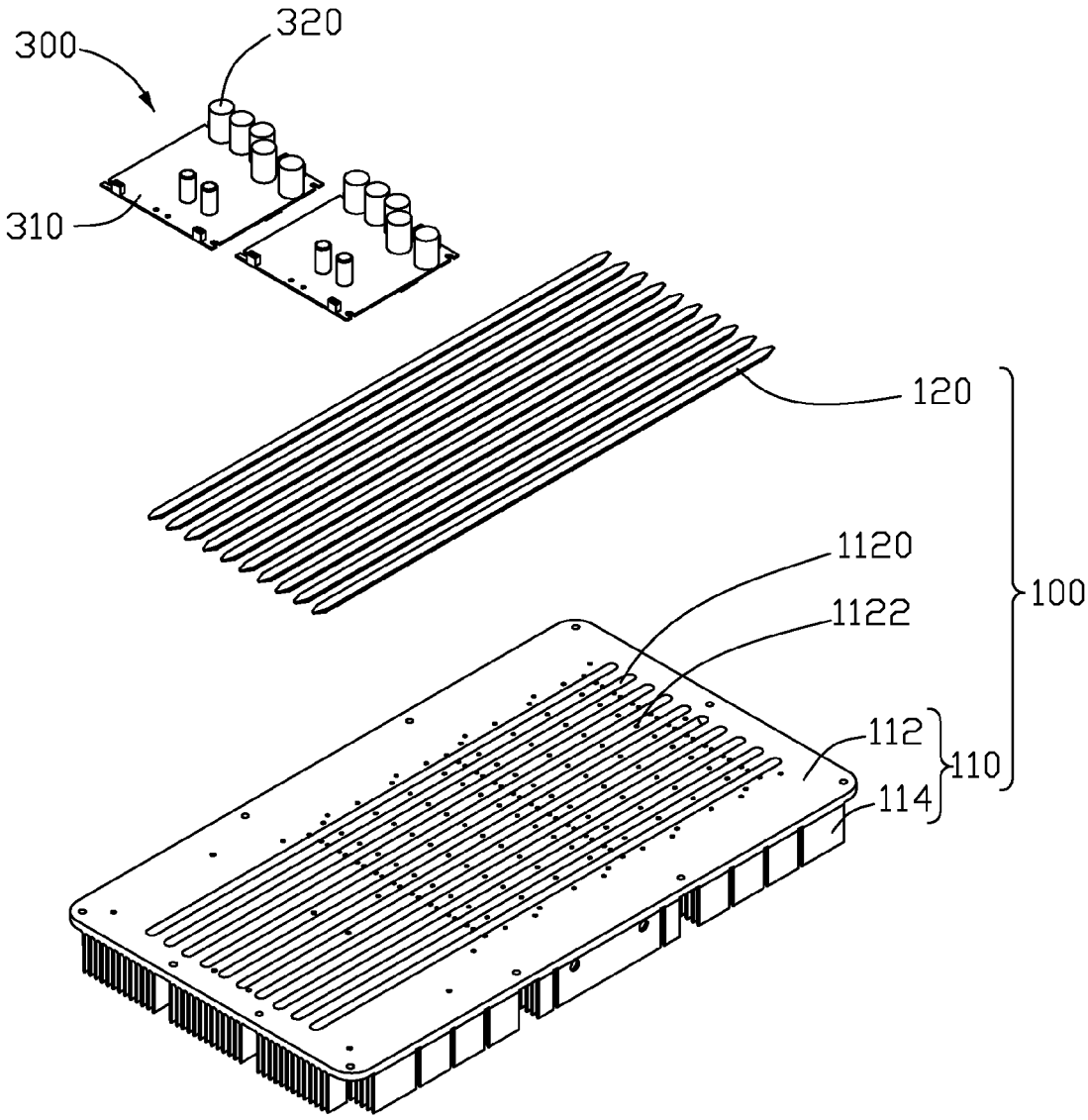
FIG. 2 is an exploded, isometric view of FIG. 1, an LED module of the LED lamp being removed.

Referring to FIG. 2, the heat dissipation apparatus 100 comprises a heat sink 110 and a plurality of heat pipes 120 embedded in the heat sink 110. The heat sink 110 comprises a rectangular base 112 and a plurality of fins 114 parallelly mounted on a bottom surface of the base 112. In a top surface of the base 112, a plurality of parallel grooves 1120 is formed. The grooves 1120 extend within the base 112 along a direction from a front end to a rear end of the base 112. In detail, the grooves 1120 extend from an area adjacent to the front end of the base 112 to an area adjacent to the rear end of the base 112.

The heat pipes 120 are installed and retained in corresponding grooves 1120, so that the heat pipes 120 extend within the base 112 along the corresponding grooves 1120. The heat pipes 120 are flattened, and top surfaces of the heat pipes 120 are coplanar with the top surface of the base 112. The base 112 further defines a plurality of screw holes 1122 in sides of the grooves 1120. Screws (not shown) extend through the LED module 200 and threadedly engage into corresponding screw holes 1122 to secure the LED module 200 on the top surface of the base 112.

The LED module 200 comprises a plurality of elongated printed circuit boards 210 positioned at middle and rear portions of the top surface of the base 112. The LED module 200 further comprises a plurality of evenly spaced LEDs 220 mounted on each printed circuit board 210. The printed circuit boards 210 together with the LEDs 220 are juxtaposed on the top surface of the base 112 in such a manner that each printed circuit board 210 is arranged over one heat pipe 120, and front ends of the heat pipes 120 located close to the front end of the base 112 extend beyond the printed circuit boards 120. The printed circuit board 210 can be secured on the top surface of the base 112 via the screws extending therethrough to threadedly engage into corresponding screw holes 1122 of the base 112. By such design, heat produced by the LEDs 220 can be conducted downwardly and absorbed by the heat pipes 120, when the LEDs 220 are powered to lighten by the converters 300.

The converters 300 each are electrically connected to several printed circuit boards 210 and convert an AC, high voltage power from a conventional power outlet to a DC, low voltage power which is supplied to the LEDs 220. In general, the AC/DC converters 300 are well known. The AC/DC converter 300 may be any conventional converter that is small enough to fit in the LED lamp near the printed circuit boards 210.

Figure 3:
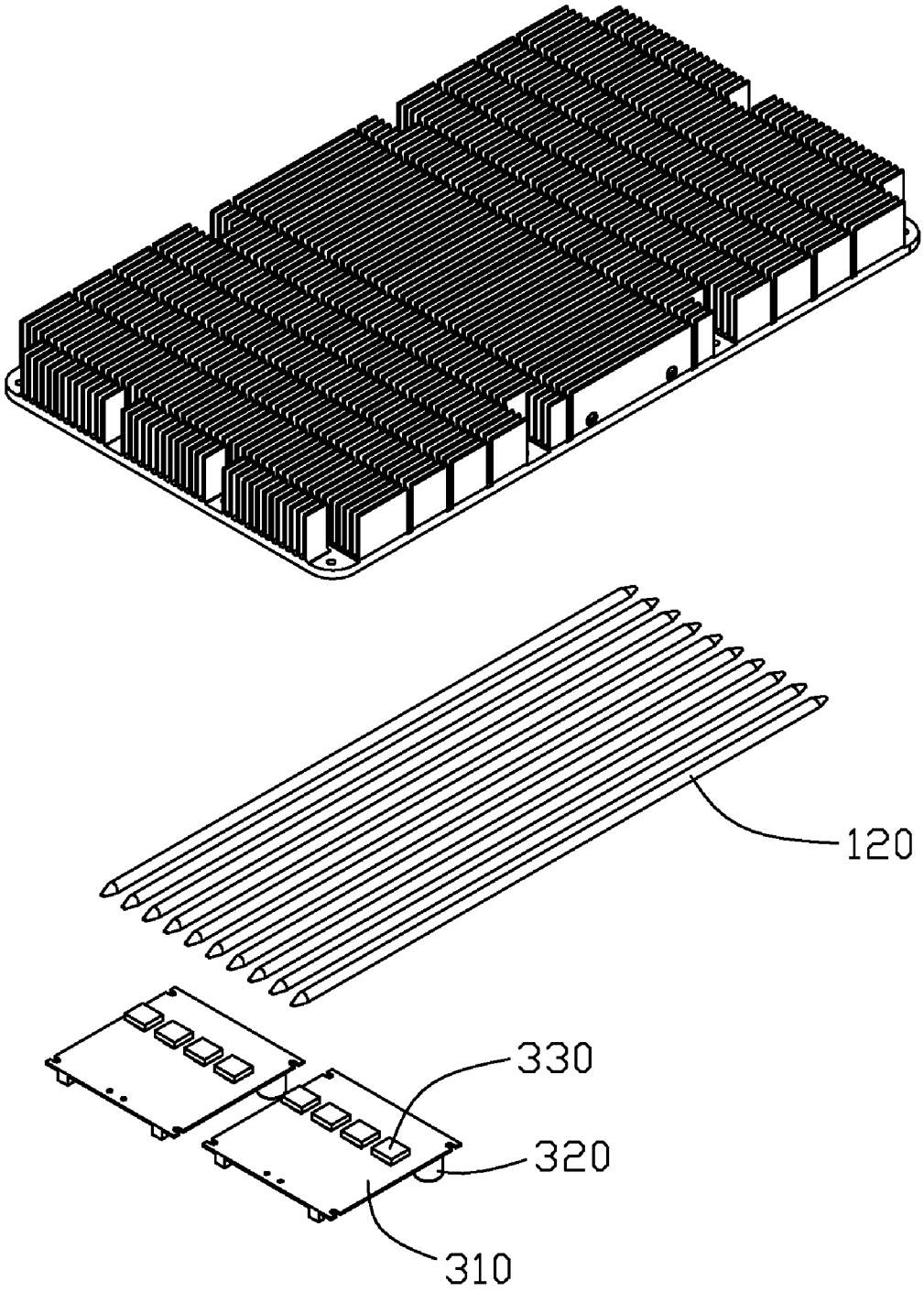
FIG. 3 is a view similar to FIG. 2, but viewed from another aspect.

As shown in FIGS. 2-3, each converter 300 comprises a driver printed circuit board 310 having a driver circuit (not shown) formed thereon, a plurality of capacitors 320, and a plurality of heat-generating driver components 330, such as MOSFETs. The capacitors 320 are mounted on a top surface of the driver printed circuit board 310, and the heat-generating driver components 330 are positioned on a bottom surface of the driver printed circuit board 310. The driver printed circuit boards 310 of the two converters 300 are juxtaposed on a front portion of the top surface of the base 112 near a front end of the LED module 200. The heat-generating driver components 330 are in direct contact with the top surfaces of the base 112 and the heat pipes 120, so that heat originated from the heat-generating driver components 330 is directly absorbed by the base 112 and the heat pipes 120, simultaneously. Therefore, heat produced by the heat-generating driver components 330 can be quickly removed away to keep the converters 300 within acceptable temperature range. Thermal interface material such as thermal grease or thermal tapes can be applied to a bottom face of each of the heat driver components 330, whereby the heat driver components 330 can have an intimate contact with the heat pipes 120 and the top face of the base 112. Thus, heat generated by the heat driver components 330 can be effectively transferred to the heat pipes 120 and the top face of the base 112.

As described above, both of the printed circuit boards 210 and the driver printed circuit boards 310 are arranged on the top surface of the base 112 with the heat pipes 120 located below the driver printed circuit boards 310 and the printed circuit boards 210. In other words, the heat pipe 120 comprises a first portion positioned between the LED module 200 and the base 112, and a second portion positioned between the base 112 and the bottom surface of the driver printed circuit board 310. Heat produced by the LEDs 220 and the heat-generating driver components 330 is absorbed by the base 112 and the heat pipes 120, and then conducted to the fins 114 to be dissipated. Therefore, the LED lamp can work within an acceptable temperature range.

Figure 4:
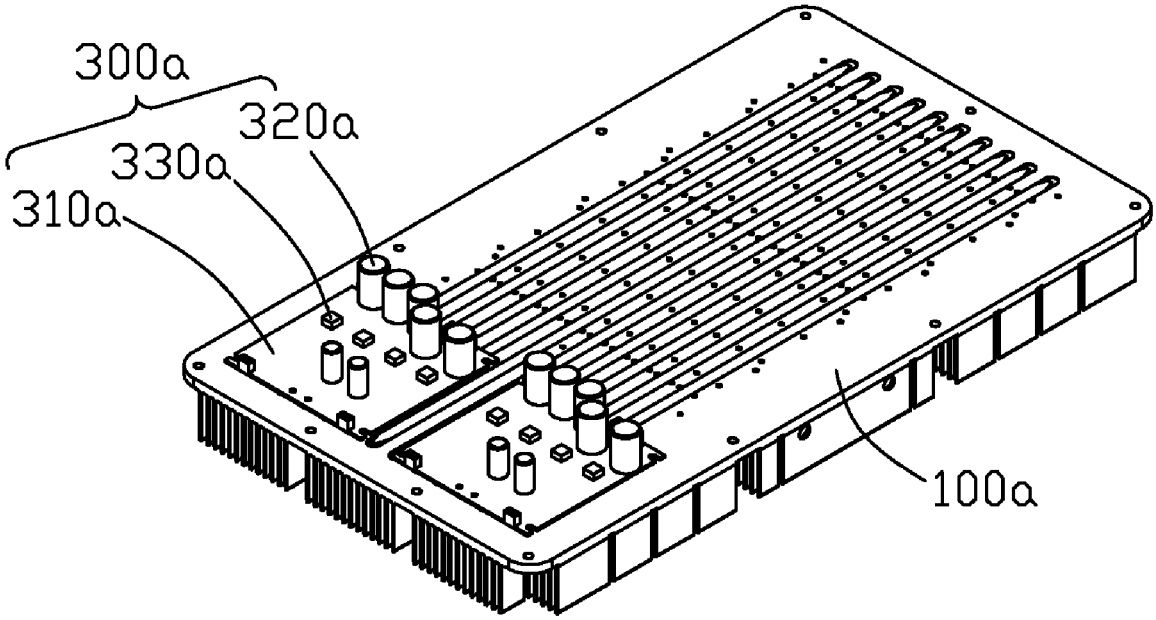
FIG. 4 is an isometric view of an LED lamp in accordance with another preferred embodiment of the present invention, wherein an LED module of the LED lamp is removed.
Figure 5:
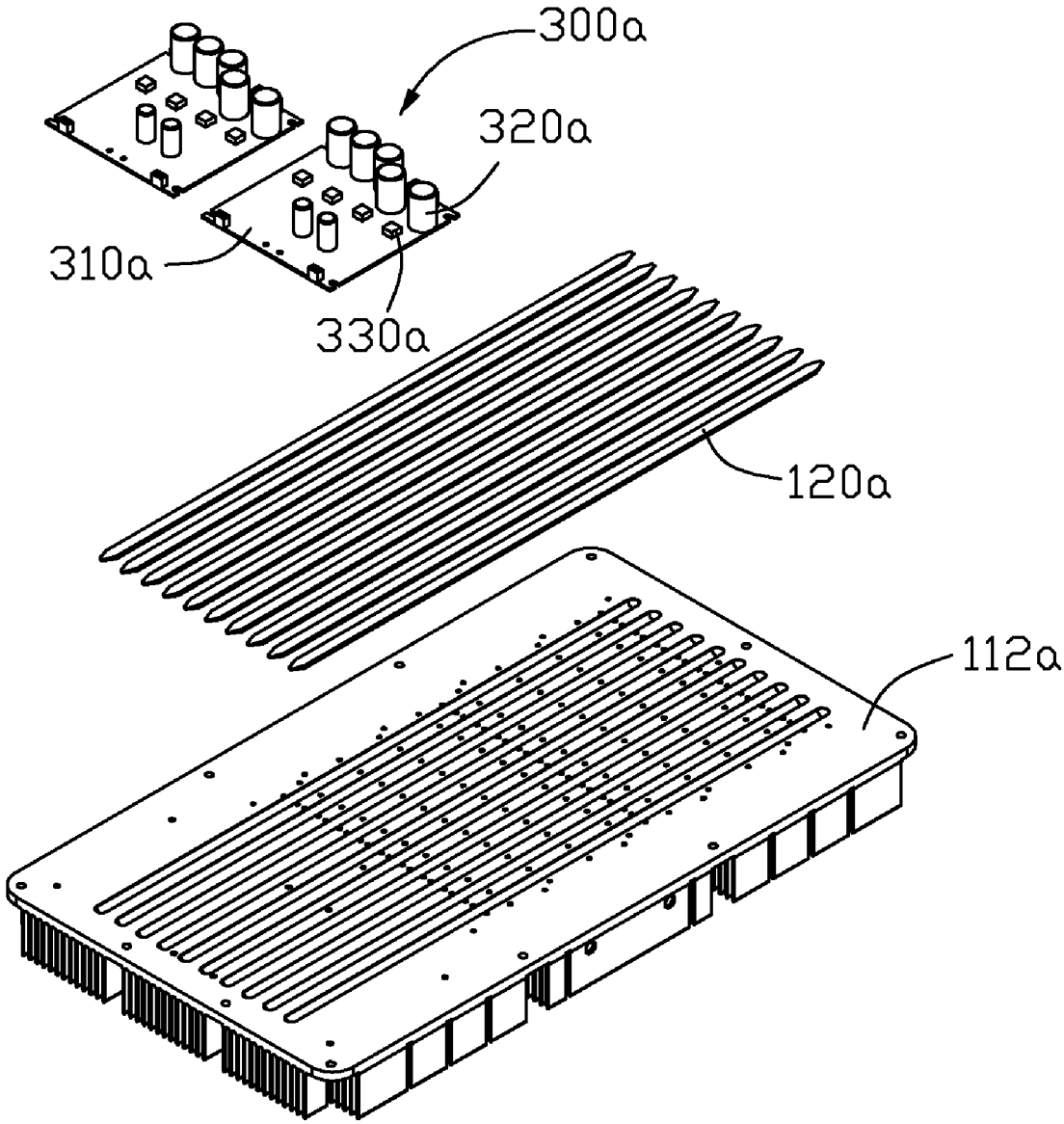
FIG. 5 is an exploded, isometric view of FIG. 4.
Figure 6:
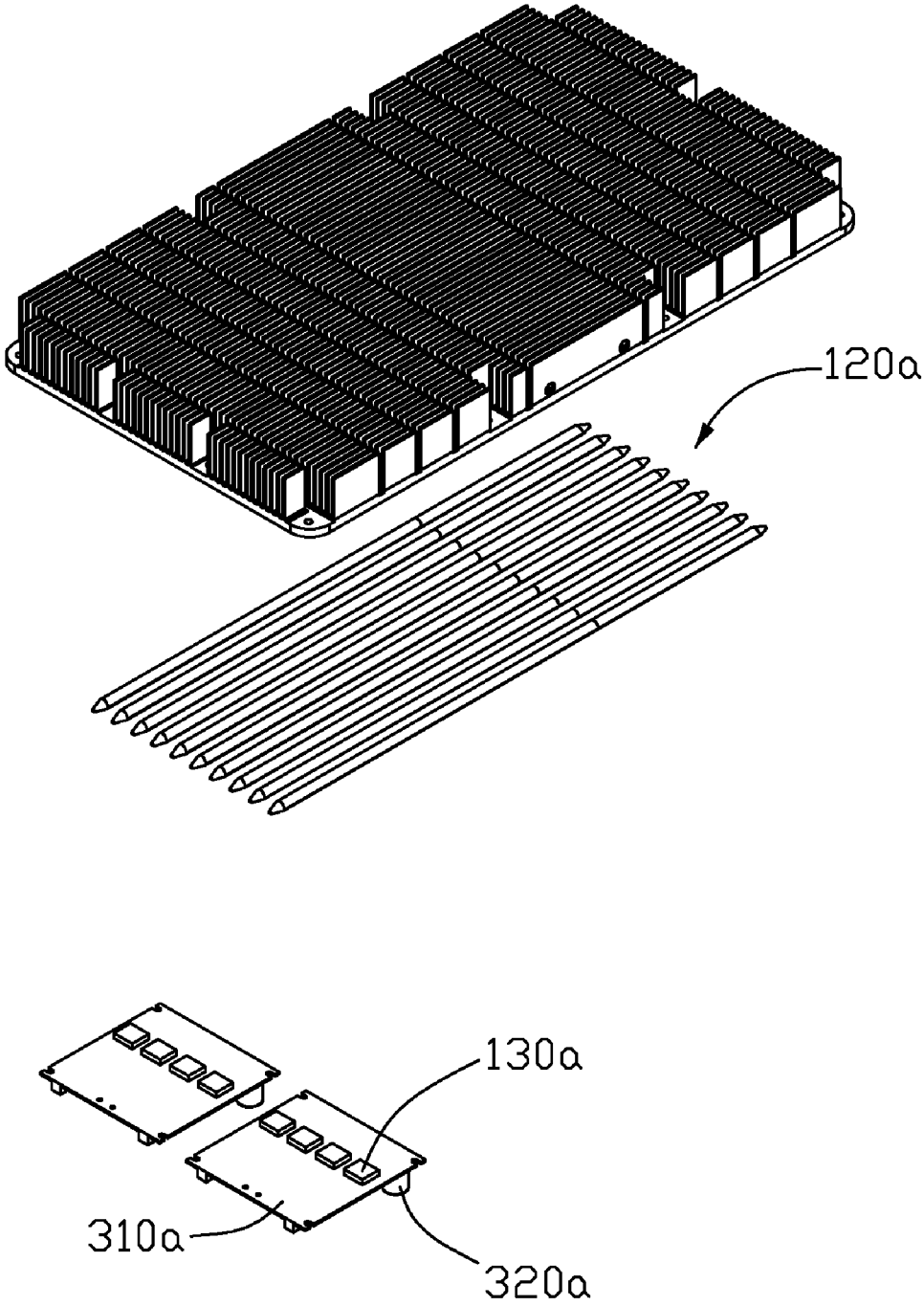
FIG. 6 is a view similar to FIG. 5, but viewed from another aspect.

Referring to FIGS. 4-6, an LED lamp of another preferred embodiment of the invention is shown. The second embodiment has a structure similar to that of the previous embodiment, except two AC/DC converters 300*a*. The main difference between the converters 300*a* and the converters 300 is that capacitors 320*a* and heat-generating driver components 330*a* of the converter 300*a* are mounted on a top surface of a driver printed circuit board 310*a* of the converter 300*a*. A heat dissipation apparatus 100*a* comprises a plurality of thermal conductors 130*a*, such as thermal tapes or heat conducting blocks, which is positioned on a front portion of a top face of a base 112*a* of the heat dissipation apparatus 100*a*. When the converters 300*a* and an LED module (not shown) are positioned on the top surface of the base 112*a* in a similar manner to that of the previous embodiment, the thermal conductors 130*a* are located just below corresponding heat-generating driver components 330*a*. Therefore, heat produced by the heat-generating driver components 330*a* is transferred to the thermal conductors 130*a*, which have a high heat conductivity and quickly transfer the heat from the converters 300*a* to the base 112*a* and the heat pipes 120*a*, whereby the heat can be dissipated to ambient air via fins of the heat dissipation apparatus 100*a*.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED lamp comprising:

a heat dissipation apparatus comprising a base;

an LED module mounted on the base; and an AC-DC converter electrically connected to the LED module and mounted on the base near the LED module, wherein a heat-generating component of the AC-DC converter is in thermal connection with the base of the heat dissipation apparatus so that heat generated by the heat-generating component can be dissipated via the heat dissipation apparatus;

wherein the heat dissipation apparatus further comprises a heat pipe attached to the base; and wherein an outer surface of the heat-generating component is in direct contact with both of the base and the heat pipe.

2. The LED lamp as described in claim 1, wherein the LED module and the AC-DC converter are mounted on a same surface of the base.

3. The LED lamp as described in claim 1, wherein the heat pipe is embedded in a surface of the base, a top surface of the heat pipe is coplanar with the surface of the base.

4. The LED lamp as described in claim 1, wherein the AC-DC converter comprises a driver printed circuit board with a first surface and a second surface opposite to the first surface, the heat-generating component being mounted on the second surface of the driver printed circuit board, the second surface of the driver printed circuit board being located near the base than the first surface.

5. The LED lamp as described in claim 4, wherein the heat pipe comprise a first portion positioned between the LED module and the base, and a second portion positioned between the base and the second surface of the driver printed circuit board.

6. The LED lamp as described in claim 1, wherein the heat pipe extends within the base.

7. The LED lamp as described in claim 1, wherein the heat dissipation apparatus further comprises a plurality of fins mounted on the base.

8. An LED lamp comprising:

a heat dissipation apparatus comprising a base;

an LED module comprising a plurality of printed circuit boards juxtaposed on the base, and a plurality of LEDs mounted on each printed circuit board; and an AC-DC converter electrically connected to the printed circuit boards and mounted on the base at a common face of the base with the printed circuit boards, wherein heat generated by the LED module and the AC-DC converter is transferred to the common face of the base;

wherein the heat dissipation apparatus further comprises a plurality of heat pipes mounted on the base, the heat pipes extending from a portion of the base where the printed circuit boards are attached to another portion where the converter is located; and wherein the converter comprises a plurality of heat-generating components with outer surfaces in direct contact with the base and the heat pipes.

9. An LED lamp comprising:

a heat sink having a base having a first face and a second face, a plurality of fins extending from the second face;

a plurality of heat pipes embedded in the first face of the heat sink;

an LED module having a plurality of LEDs thereon being mounted on the first face of the base of the heat sink, wherein the LEDs are in thermal connection with the heat pipes; and an AC/DC converter for supplying power to the LED module being mounted on the first face of the base of the heat sink, the AC/DC converter having a heat-generating component being in thermal connection with first face of the base of the heat sink;

wherein an outer surface of the heat-generating component is in direct contact with both of the base and the heat pipe.

10. The LED lamp as described in claim 5, wherein the heat-generating component is a MOSFET.

11. The LED lamp as described in claim 8, wherein the AC-DC converter comprises a driver printed circuit board with a first surface and a second surface opposite to the first surface, the heat-generating components being mounted on the second surface of the driver printed circuit board, the second surface of the driver printed circuit board being located near the base than the first surface.

12. The LED lamp as described in claim 11, wherein the heat-generating components are MOSFETs.

* * * * *